United States Patent [19]

Hohenberg et al.

[11] Patent Number: 4,767,397

[45] Date of Patent: Aug. 30, 1988

[54] APPARATUS FOR LIQUID SEPARATION

[75] Inventors: Rudolph Hohenberg, Wellesley, Mass.; Carl G. Figdor; Willy S. Bont, both of Amsterdam, Netherlands

[73] Assignee: Damon Corporation, Needham Heights, Mass.

[21] Appl. No.: 23,436

[22] Filed: Mar. 9, 1987

[51] Int. Cl.[4] ..... B04B 7/00

[52] U.S. Cl. ..... 494/85; 494/16; 494/45; 604/6; 604/410

[58] Field of Search ..... 494/85, 16, 17, 18, 494/20, 31, 35, 37, 45, 43, 44; 604/408, 409, 410, 6, 212, 214, 182; 383/904, 906, 122, 104, 119, 901; 422/255

[56] References Cited

U.S. PATENT DOCUMENTS

| | | | |
|---|---|---|---|
| 513,238 | 1/1894 | Lalonde | 604/182 |
| 1,177,759 | 4/1916 | Butler | 604/182 |
| 3,489,145 | 1/1970 | Judson | 128/214 |
| 3,519,201 | 7/1970 | Eisel | 233/21 |
| 3,679,367 | 7/1972 | Negersmith | 23/259 |
| 3,724,747 | 4/1973 | Unger | 233/3 |
| 4,098,456 | 7/1978 | Bayham | 233/14 |
| 4,389,905 | 8/1983 | Romanauskas | 494/16 |
| 4,405,079 | 9/1983 | Schoendorfer | 494/1 |
| 4,413,771 | 11/1983 | Rohde | 494/17 |
| 4,413,772 | 11/1983 | Rohde | 494/17 |
| 4,413,773 | 11/1983 | Rohde | 494/37 |
| 4,419,089 | 12/1983 | Kolobow | 494/45 |
| 4,421,503 | 12/1983 | Latham | 494/17 |
| 4,447,220 | 5/1984 | Eberle | 494/26 |
| 4,531,932 | 7/1985 | Luppi | 604/6 |

FOREIGN PATENT DOCUMENTS

| | | |
|---|---|---|
| WO81/03626 | 12/1981 | PCT Int'l Appl. . |
| WO87/01307 | 3/1987 | PCT Int'l Appl. . |

OTHER PUBLICATIONS

Judson, Closed Continuous Flow Centrifuge, Nature, vol. 217, Mar. 2, 1968 pp. 816–818.

*Primary Examiner*—Robert W. Jenkins
*Attorney, Agent, or Firm*—Lahive & Cockfield

[57] ABSTRACT

Apparatus for the centrifugal fractionation and component-isolation of liquid material has a nonflexing radially-movable pressure panel disposed between a first liquid container stacked radially in front of a second liquid container. The two containers are at the same interval pressure during centrifugation, and the pressure panel avoids radial distortion of the back wall of the first container. The liquid container structure can incorporate the pressure panel. Alternatively, the panel can be part of the centrifugal separating instrument.

16 Claims, 4 Drawing Sheets

APPARATUS FOR LIQUID SEPARATION

BACKGROUND

This invention relates to apparatus for fractioning liquid with centrifugation and for selectively compartmenting or otherwise isolating the fractions.

More particularly, the invention provides a container structure that facilitates separating a liquid, particularly a body fluid, into fractions with centrifugal force, and with high purity of each isolated component and with high yield. The invention also provides improvements for an instrument that centrifugally fractions a liquid and isolates the fractions. The invention is described with reference primarily to the processing of blood. Features of the invention may however be used with other liquids, particularly liquid suspensions containing bone marrow, tissue or other cells.

Human blood has four components which, in order of increasing specific gravity, are: blood plasma, blood platelets, white blood cells and red blood cells. White blood cells and blood platelets, together called buffycoat, constitute in total approximately one percent of the volume of normal blood. Red blood cells account for approximately forty-five percent of the total volume. The blood plasma constitutes the balance, or approximately fifty-four percent. Nominal specific gravities of the blood components are: blood plasma 1.03; red blood cells 1.08 to 1.11; blood platelets 1.05; and white blood cells 1.055 to 1.085.

Blood components can be classified into further constituents which it may be desirable to isolate. For example, white blood cells can further be classified as mononuclear cells and as granulocytes. Red blood cells can be further distinguished between older cells, namely gerocytes, and newly formed cells termed neocytes. The average lifetime of a red blood cell is approximately ninety days. New cells, which are expected to have a relatively longer life, are of greater importance for blood transfusion. The specific gravity of red blood cells increases as they age, so that with the aid of centrifuging it is possible to achieve a distribution of red blood cells according to age.

The demand for different blood components, each with high purity, is significant and is increasing. For example, in order to avoid undesired immunological reactions in patients as a result of transfusion, it often is desirable to administer a patient with only selected blood components.

The extensive publications regarding the fractionation of blood with centrifugal force include European Patent Office patent No. 0,026,417 and PCT international publication No. WO81/03626.

These publications primarily concern mechanisms for subjecting blood to centrifugal force, pumping and other processing to isolate components. There is also significant need, however, for improvements in the container structures that contain the whole blood, from the time of initial collection to fractionating, and the subsequent isolation of the resultant components.

Accordingly, it is an object of this invention to provide container apparatus for liquid being centrifugally fractionated, and the components isolated, and which provides a relatively high degree of constituent purity, with relatively high yield. It is a further object that the container apparatus provide for component separation and isolation in a relatively brief time and be suitable for use with automated processing.

Another object is to provide such container apparatus that maintains closed system sterility after being filled with whole blood.

A further object is that the container apparatus of the above character be suited for low cost manufacture with mass production techniques.

It is also an object of this invention to provide improvements in equipment for centrifugally fractionating liquid, and isolating the fractions, with a relatively high degree of constituent purity and relatively high yield, particularly in brief time and suited for automatic operation.

Other objects of the invention will in part be obvious and will in part appear hereinafter.

SUMMARY OF THE INVENTION

Container apparatus according to the invention has, in one instance, a compartment in which blood or other cell-containing liquid is stored and is centrifugally fractionated, and has further compartments in which different fractionated components are isolated.

For the processing of whole blood, the container apparatus has two major compartments, namely a collection compartment and a plasma compartment, interconnected by a passage that provides additional component storage.

According to one feature of the invention, the collection compartment is configured to support whole blood contained therein for centrifugation to separate plasma, platelets and white cell from the red cells with a high degree of purity and yield. To this end the collection compartment is configured for orientation for centrifugal separation to dispose an outlet port centrally along lateral axes and radially inwardly and at only a small radial distance from the radial outermost wall.

In one embodiment, the collection compartment forms a shallow chamber, of small radial depth. An outlet port having a funnel-like conical configuration apertures the middle of the compartment inner wall. Such a compartment can be formed, for example, with front and rear panels joined together at the peripheries to form a pillow-like or envelope-like configuration, and with the outlet port on the front panel.

Further, the container structure distributes pressure substantially uniformly over the back wall of the collection compartment and forestalls compartment distortion. During orientation for centrifugation, the back wall is radially behind the inner wall. One advantage of the pressure distribution structure which the invention provides is to avoid a localized occlusion of the collection compartment, between the front and back walls, and thereby avoid disruption of flow between the compartments. One preferred embodiment of this pressure distributing structure is a panel of the back wall of the container that has relatively less flexibility than the remaining wall structure.

This pressure-distributing feature of a collection compartment according to the invention is advantageous, in one instance at least, where the collection compartment is located on a centrifugal separator contiguously in front of, and hence at a smaller radius than the plasma compartment, which it abuts. The front wall of the collection compartment abuts a selectively-dished rigid wall of the separator instrument.

The red blood cells remain in the radially-inner collection compartment, while the less dense plasma is removed to the radially-outer plasma compartment. With continued centrifuging and pumping for further fraction isolation, the collection compartment back wall, which abuts the plasma compartment front wall, may tend to distort radially and occlude flow from the collection compartment, thus disadvantageously interrupting the isolation of fractions. The pressure-distributing structure avoids this compartment occlusion. It thereby allows the fraction isolation to proceed to attain high yield and purity of the isolated fractions.

One preferred embodiment of the collection compartment thus has resiliently flexible front and back walls bonded together at their peripheral edges with a funneling output port aperturing the front wall at a central location. Further, the central portion of the back wall, opposite the exit port, has a pressure distributing portion of materially lesser flexibility, i.e., of stiffer material, than along the peripheral portion which spans the remainder of the panel back wall. With this structure, the collection compartment walls normally are flat, coplanar and substantially contiguous when the compartment is empty. When the compartment is filled with liquid to be fractionated, the front wall and the peripheral portion of the back wall flexibly pillow concavely outward and apart. The pressure distributing panel of the back wall, however, remains substantially flat. The filled compartment has a thickness, between the front and back walls that is materially smaller than any lateral dimension, e.g., than the length or the width, of the two walls.

The pressure distributing panel preferably is centered opposite the funneling exit port on the front wall. The exit port typically has a circular cross-section with an area at the front wall that is a minor portion of the front wall area. The pressure panel on the back wall typically has a larger lateral extent than the exit port opening in the front wall. Moreover, the pressure panel typically has an area that constitutes a major portion of the area of the back wall.

After centrifuging a liquid within the collection compartment, with the exit port oriented radially inwardly so that the least dense fraction collects there, the separating mechanism withdraws liquid from the compartment by way of the exit port, and typically by the action of a peristaltic pump on resiliently flexible tubing leading from the exit port. The least dense constituent in the liquid exits first. During continued liquid withdrawal, progressively increasingly denser constituents exit from the compartment. The separating mechanism typically continually supplies centrifugal force to the collection compartment during this component isolation operation.

As liquid is withdrawn from the collection compartment and the two opposed walls of the collection compartment draw together, the pressure distributing panel of the back wall maintains a space between the two opposed walls throughout the span of the panel. That is, the panel substantially avoids the likelihood that the back wall distorts radially, even locally. Such a distortion of the back wall is deemed disadvantageous, in that it tends to occlude flow from the collection compartment, and thereby interrupts the desired component isolation.

According to a further feature of the invention, the inner surface of the collection compartment front wall, and typically also the inner surface of the funneling exit port, are configured and finished to be resistant to any residue of material. That is, these inner surfaces have mininal attraction for constituents. Instead, the constituents flow along these compartment surfaces with minimal shear, drag or friction, and hence with minimal residue, e.g., cells collecting there. The invention attains these advantageous results in one instance by providing the specified inner surfaces with a high degree of smoothness. This is contrary to one prior practice of texturing the inner surface of a blood bag wall. The invention also minimizes the residue of cellular material in the collection compartment by arranging the front wall to present a progressive decrease in radius, on the centrifugal instrument, to cells as they move to the compartment exit port. More particularly, the container front wall is configured to tend normally to have a concave shape, and the instrument supports that shape. The radial location of the compartment front wall, particularly when disposed in the instrument, thus progressively decreases from the compartment periphery to the exit port. Thus cellular material encounters a progressively increasing centrifugal force as it is moved from the compartment periphery to the exit port.

In further accord with the invention, a second compartment, e.g., a plasma compartment in container structure for the processing of blood, is provided. The plasma compartment is typically fabricated similar to the collection compartment with front and back walls joined together at their peripheral edges. However, distinct from the collection compartment, opposed walls of the second, plasma compartment, at least in a structure for isolating components of blood, have similar high flexibility, typically of the same magnitude as the flexibility of the front wall of the collection compartment.

Yet another feature of the two-compartment structure is that the two compartments are configured so that the plasma compartment can be stacked radially outwardly of, i.e., behind, the collection compartment. The two compartments have substantially identical peripheral contours and hence can be stacked substantially in register, one behind the other. Further, in a preferred practice of this feature, the edge contour of the plasma compartment when empty is the same as the peripheral contour of the collection compartment when filled with liquid to be fractioned. This identical peripheral contour of the two compartments enhances supporting them in radially stacked relation for centrifuging. It also minimizes crimping, distorting, or otherwise folding either compartment in a manner that creates a stress concentration that can lead to rupture or leakage of a compartment, especially during high speed centrifuging.

The two radially-stacked compartments typically are in pressure communication, to have the same internal pressures during component separation. In one instance, the two compartments abut, i.e., the front wall of the plasma compartment contiguously abuts against the back wall of the collection comparment. The rigid pressure panel of the collection compartment is hence at this interface with the plasma compartment.

Flexible tubing, of selected inside diameter and length to provide a desired tubing volume, forms a passage which provides liquid communication between the two compartments. The passage supports flow between the collection compartment exit port and the plasma compartment. The passage preferably has different, serially successive sections with different diameters, or is otherwise arranged to provide selected storage volumes at different locations along its length.

The invention can also be practised with the rigid pressure panel being on the front wall of the plasma compartment, instead of on the collection compartment. A further alternative, according to the invention, is to provide the separating instrument with a pressure panel interposed between the radially-stacked compartments. More particularly, a two-compartment container structure according to the invention can have a plasma compartment with a central portion of the front wall having little flexibility, i.e., being substantially stiff and non-flexing. In this instance, the back wall of the collection compartment can be flexible throughout, i.e., without a stiff pressure panel.

Where the centrifugal separating instrument includes a pressure panel and seats the two compartments on either side of the panel, no pressure-panel is required on the container compartments; that is, both container compartments can have equally-flexible front and back walls. The instrument preferably mounts or otherwise supports the pressure panel to locate it laterally and to allow it to move radially, as the collection compartment empties and the plasma compartment fills. The mounting structure according to the invention provides this radial movement with substantially minimal restraint.

The invention provides container structure which attains the foregoing features in a system that can readily be sealed for sterility after the collection therein of blood or other liquid to be processed. The container system can remain sealed throughout the centrifugal processing that fractionates the liquid and transports the separated components to selected different compartments, or locations, for the desired isolation.

The invention accordingly comprises the features of construction, combinations of elements and arrangements of parts exemplified in the constructions hereinafter set forth, and the scope of the invention is indicated in the claims.

BRIEF DESCRIPTION OF THE DRAWINGS

For a fuller understanding of the nature and objects of the invention, reference is to be made to the following detailed description and the accompanying drawings, in which.

DESCRIPTION OF ILLUSTRATED EMBODIMENT

Figure 1:
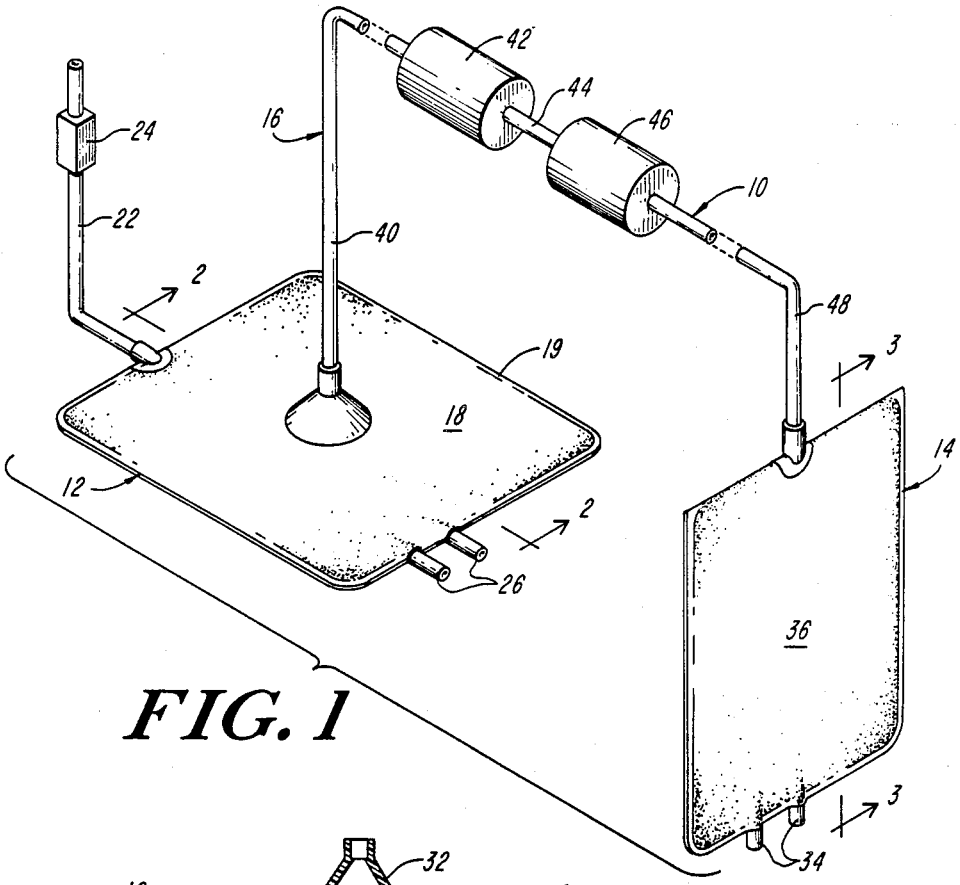
FIG. 1 is a pictorial representation of a two compartment container structure embodying features of the invention.

A container system 10 according to the invention for the collection, storage, fractionation, and component isolation of blood has, as FIG. 1 shows, a collection compartment 12, a plasma compartment 14, and a fluid passage 16 that stores separated components and provides fluid communication between the two compartments 14 and 16. The passage 16 also provides a physical connection joining the compartments 12 and 14 together.

Figure 2:
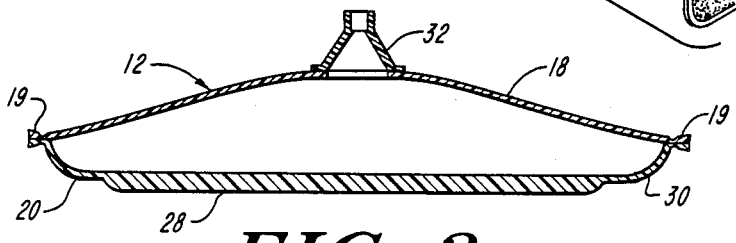
FIGS. 2 and 3 are cross-sectional views of the two compartments, respectively, shown in FIG. 1 and taken along section lines 2—2 and 3—3.

The collection compartment 12 is illustrated as formed with a front wall 18 sealed along its peripheral edge 19 to a back wall 20, FIGS. 1 and 2. Tubing 22 is joined to the compartment 12 by sealing to the peripheral seam between the walls and provides selective sealable fluid communication between the interior of the compartment 12 and a phlebotomy needle 24. The illustrated collection compartment 12 also has two selectively sealable access ports 26, 26 sealed to the juncture between the front and back walls.

The container 12 front and back walls 18 and 20 preferably are identical in size and are of thin, flexible synthetic polymer sheet material as conventionally used in blood collection containers. However, the back wall 20 has a major central portion 28 which is substantially nonflexing, or semi-rigid. This panel portion 28 of the compartment back wall accordingly remains substantially flat and planar, not only when the compartment is empty but also when it is filled with a selected volume of liquid. The back wall 20 thus has a hinge portion 30 formed by the wall portion peripherally outward of the central semi-rigid panel portion 28.

Aside from the selectively sealable access from the compartment 12 to the phlebotomy tubing 22 and at the ports 26, the compartment is liquid-tight except at a funneling conical exit port 32 which centrally apertures the compartment front wall 18. The illustrated exit port 32 has a conical funnel-like configuration of circular transverse cross section, with the largest diameter sealed to the compartment front wall 18. The minimal diameter at the other end of the exit port is joined to and in fluid communication with the passage 16.

The material which forms the inner surface of the front wall 18 and which forms the inner surface of the conical exit port 32 is selected and arranged to present a smooth, low shear, low friction, low drag, and nonadherent surface to the liquid being processed and to each fraction of it. This surface selection, configuration, and finish of the compartment front wall and exit port allows liquid fractions to flow across the surfaces with minimal restraint of any nature, other than containment, by the containing surface and with minimal entrapment or other pickup of material. The compartment front wall 18 and the conical port 32 accordingly preferably have highly smooth inner surfaces, and are free of seams and other surface roughness or projections.

Figure 3:
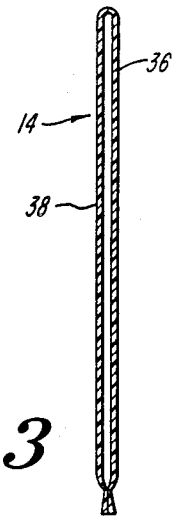

With reference to FIGS. 1 and 3, the illustrated plasma compartment 14 is fabricated with two opposing walls each of similarly flexible sheet material, typically the same as that used for the front wall 18 and hinge portion 30 of the compartment 12, and joined together at the peripheral edges to form a sealed chamber. Selectively sealable access ports 34, for selectively introducing or withdrawing liquid from the compartment 14, are conveniently provided by sealing them to the peripheral seam between the opposing walls of the compartment 14. The end of the passage 16 remote from the compartment 12 is similarly joined to the compartment 14 walls 36 and 38 as shown. As described further below, the peripheral edge contour of the collection compartment 12 and of the plasma compartment 14 are preferably substantially identical. In particular, the peripheral contour of the collection bag when filled to the desired volume of liquid to be processed is preferably substanially identical to that of the plasma compartment 14 when empty. This identical peripheral contour structure of the two compartments enables them to be stacked radially one behind the other, specifically with the plasma compartment behind the collection compartment, for centrifuging. Neither compartment is crimped or folded and neither compartment significantly overlapps the other one, i.e., they are substantially in registration with one another.

With further reference to FIG. 1, the illustrated passage 16 has several sections in successive fluid communication for enhancing several containment, control and processing functions. In particular, a connective tubing section 40 leads from the exit port 32. This passage section typically is of flexible tubing which can be occluded by an external control valve or like mechanism. The connective section 40 feeds into a chamber section 42. A tubing linking section 44 feeds from the chamber section 42 to a further chamber section 46. The remaining length of the illustrated passage 16 is a tubing section 48 which feeds from the second chamber 46 to the plasma compartment 14. The tubing section 48 typically has sufficient length and flexibility and resiliency for engagement with a peristaltic pump to pump liquid therein. The tubing link section 44, as well as the pumping tubing section 48, may if desired be adaptable for occluding by an external valve or like device.

Further, one or more of the passage sections—and typically one or more of the sections 40, 44 and 48—cooperate with an external sensor of the liquid material within. For example, the pumping tubing section 48 typically is sufficiently optically transparent for an optical sensor external to the tubing to sense the optical properties of the fluid therein, such as oppacity and/or reflectivity.

The overall construction of the collection compartment 12 is selected, when the compartment is oriented in a centrifugal separating mechanism with the conical port 32 facing radially inward and the back wall 20 being disposed outermost, to have a relatively small radial dimension at all locations between the front wall 18 and the back wall 20. With the pillow-like compartment cross-section, as shown in FIG. 2, even the greatest radial dimension, i.e., between the radial inner point of the front wall, i.e. at the middle where the exit port is located, and the panel portion of the back wall 20, is small relative to the other, lateral, dimensions of the compartment.

Further, the collection comparment is structured to assume readily a pillow-like shape, as FIG. 2 shows, during centrifuging with liquid therein. The pillow-like shape has minimal height, i.e., radial span between front wall 18 and back wall 20, at the compartment periphery. The radial spacing is greatest at the compartment center, where the exit port 32 apertures the front wall 18. It increases progressively from the compartment periphery 19 to the maximum value at the center. This compartment 12 configuration supports a migration of less dense constituents, when acted on by heavier constituents during centrifuging, radially forward and laterally centrally, and hence toward the exit port 32. The attainment of this centrifuging constituent movement at every point within the collection compartment 12 enhances high yield and high purity fractionation.

It will also be seen that the peripheral contour of the collection compartment 12 is generally squaroid or circuloid, i.e., with the aspect ratio of the maximum lateral dimension to the minimum lateral dimension in the order of magnitude of, and relatively close to, unity. This configurational feature provides a substantial uniform maximum path length of travel for material anywhere along the compartment periphery to the exit port 32. This nominal aspect ratio structure enables a constituent particle located anywhere along the compartment 12 periphery to travel, under centrifugation typically coupled with pumping as described below, to the exit port in substantially the same time anywhere along the compartment periphery. As a result, the collection compartment 12 provides separation of blood and other body fluids with minimal time.

Manufacturing considerations and operator considerations make it typically desirable to depart slightly from a unity aspect ratio. For example, with a unity aspect ratio an operator may, unless other precautions are taken, erroneously orient the collection compartment 12 improperly in a fractioning instrument.

By way of further illustration and without limitation, one particular embodiment of a container system as shown in FIG. 1 has the following specific structure. The collection compartment 12 has a volumetric capacity of 670 milliliters, and when empty has a length dimension, illustratively from left to right in FIG. 2, of 6.5 inches and a width dimension transverse thereto of 5.5 inches. The diameter of the exit port 32 at the juncture with the compartment front wall 18 has an inside diameter of 0.67 inch.

The compartment of this illustrative example thus has a length-to-width aspect ratio of 1.2 when empty. The compartment front wall is of polyvinyl chloride with plasticizer compatible with the liquid to be processed. The PVC sheet material is 0.016 inch thick, and has a modulus of elasticity less than $1\times10^3$ psi. The back wall is of the same material as the front wall, with a stiffening panel bonded to the outer surface to form the panel portion 28. The illustrated stiffening panel has a modulus of elasticity at least a factor of ten greater than the sheet material that forms the front wall and the back wall hinge portion. This larger modulus, and the added thickness, give the panel portion 28 the desired stiffness. Further, the back wall panel portion 28 has a contour comparable to that of the overall back wall with a length dimension of 4.5 inches and a width dimension of 3.5 inches, and has radiused corners. The maximum spacing between the walls 18 and 20 of the filled compartment 12 is 1.2 inch. The plasma compartment 14 is made of the same material as the collection compartment front wall, and has a length of 6.5 inches and a width of 4.5 inches when empty. It thus has a length-to-width aspect ratio of 1.4. The volume of the plasma compartment is 540 milliliters.

The passage 16 of this illustrative example is also of PVC material with selected compatible plasticizer, and has a total volume of 0.45 cubic inch from the conical exit port 32 to the plasma compartment 14. The passage sections 40, 44 and 48 are of flexible tubing with a nominal inside diameter of 0.16 inch. The chamber sections 42 and 46 have generally cylindrical configurations of 0.10 cubic inch volume, and 0.25 cubic inch volume, respectively. Each chamber section 42 and 46, as well as other sections of the passage 16, where desired can have fluid ports for either introducing or withdrawing liquid material.

Figure 4:
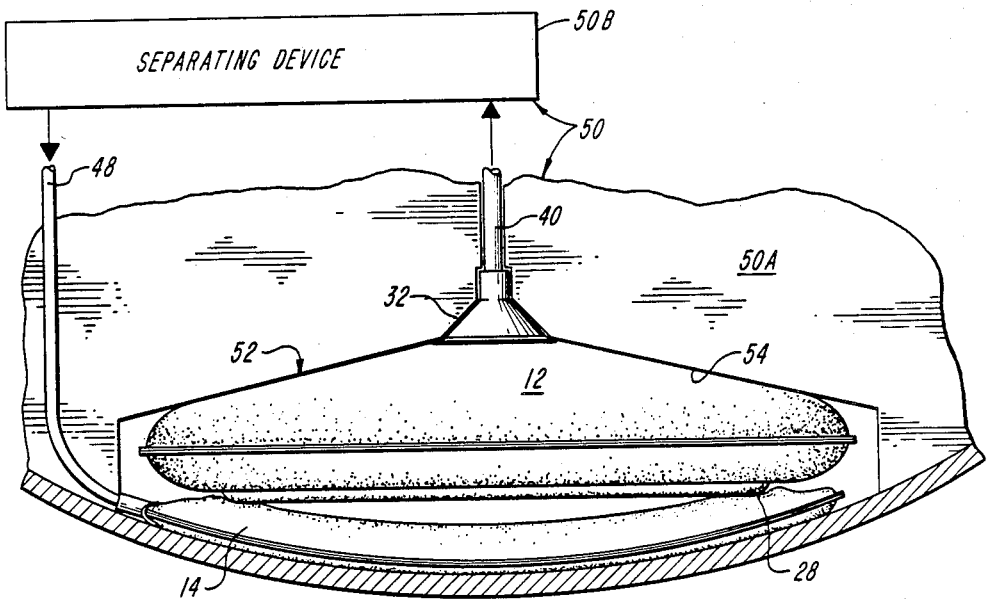
FIG. 4 is a top plan view of the two compartments shown in FIG. 1 in radially stacked configuration in centrifugal processing equipment prior to the transfer of liquid from the collection compartment to the plasma compartment.

With reference to FIG. 4, in one mode of operation, after the collection compartment 12 is filled with blood drawn from a donor according to conventional practice, the system 10 is loaded into a centrifugal separating instrument indicated generally at 50 and having a rotor 50A coupled with other separating elements indicated at 50B. The instrument has a rotor receptacle 52 which supportingly receives the two compartments 12 and 14 radially stacked one behind the other with the plasma container 14 outermost. Both compartments are oriented on edge with the larger lateral, i.e., length, dimension horizontal and the smaller lateral dimension, i.e., width, vertical. The two walls of each compartment are hence spaced apart radially. The conical funneling exit port 32 of the compartment 12 is radially innermost, and the collection compartment panel portion 28 is adjacent to and abuts the inner wall of the plasma compartment. With this arrangement, the contents of the two compartments 12 and 14 are at the same internal pressure, even during centrifuging.

All external ports leading to or from the compartment 12 are closed, including the phlebotomy tubing 22. Hence the container system 10 is sealed, after collection of the blood, and does not need to be opened in any way for fractionating and component isolation. This maintenance of closure is desired to maintain sterility within the container system 10.

The rotor receptacle has a front wall 54 that has a shallow conical funnelling contour, formed either with flat pyramidal panels or with a spherical configuration. This conical shape supports the front wall 18 of the collection compartment 12 configured as described above and as shown in FIGS. 1 and 2 to promote flow of lighter fractions radially inward and centrally, i.e., toward the exit port 32.

The container system passage 16 is arranged with the connective tubing section 40, the white cell chamber 42, the link section 44, and the platelet chamber 46 in progressively decreasing radius order relative to the centrifuging rotor of the instrument 50. Further, the pumping tubing section 48 is arranged to engage a peristaltic pump of the instrument elements 50B. A further length of the tubing section 48 extends radially outward from the processing elements 50B to the plasma compartment 14 seated in the receptacle 52. The instrument 50 further includes valving elements for occluding the tubing section 40 selectively and similarly for selectively occluding the link section 44, and has sensor elements monitoring the liquid material within the pumping tubing section 48 proximal to the juncture with the platelet chamber 46.

The centrifuge of the instrument 50 is operated to separate the whole blood in the collection compartment 12, with the lowest density constituent collecting at the radially innermost location, i.e., centrally on the front wall 18 and with the highest density constituent radially outermost, i.e., at the panel portion of the back wall 20.

After this centrifugal separation and while centrifuging rotation continues, the occlusion of the connective tubing section 40 is open and any other occlusions of the passage 16 opened and the peristaltic pump operated. The pumping action applied to the passage 16, preferably to the tubing section 48, draws the least dense constituent from the collection compartment 12 by way of the exit port 32. With further withdrawal, this least dense constituent is drawn into the plasma compartment 14. Successively less dense constituents of the blood are drawn from the collection compartment to the passage 16. The instrument sensor monitoring the pumping tubing section 48 detects the transition from plasma to denser constituent at the condition where platelets are in the passage chamber section 46 and, typically, white cells are in the chamber section 42 and only red cells remain in the collection compartment 12. In response to the resultant signal from the sensor, the instrument occludes the tubing section 40, stops the pump and stops centrifuging. The desired fractionating and component isolation is now complete and the container system 10 can be removed from the instrument 50 for further processing of the blood components.

The foregoing structure of the container system 10 has been found to obtain blood separation with high purity and high yield, and with relatively brief centrifuging time with conventional centrifuging speeds and radial distances, i.e., centrifugal forces. Analysis of the fractions confirms the high purity, and analysis of the red cells residual in the collection compartment confirms the high yield, in that nill lighter constituents remain.

Figure 6:
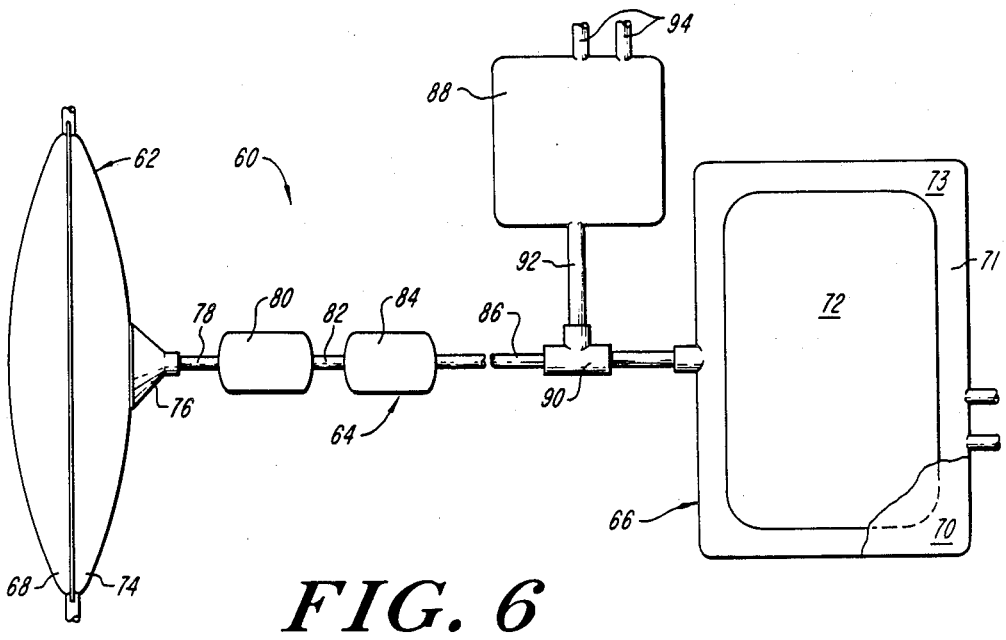
FIG. 6 is a plan view of another container structure according to the invention.

FIG. 6 shows a container system 60 that embodies two variations from the system 10 of FIG. 1. The container system 60 has a collection compartment 62 from which liquid can be withdrawn into a multiple stage passage 64 that feeds into a plasma compartment 66. The collection compartment has a back wall 68 that is equally flexible throughout, like the flexible front wall 74 that is centrally fitted with a funneling exit port 76. The passage 64 has a coupling stage 78 that connects the exit port to a first storage stage 80. A further coupling stage 82 feeds to a second storage stage 84 and a pumpable coupling stage feeds at the remote end of the passage 64 into the plasma compartment 66. The plasma compartment has a back wall 70 equally flexible as each wall of the compartment 62 and has a front wall 71 that has a central low flexibility panel 72 and a flexible peripheral portion 73. The illustrated front wall 70 of the plasma compartment thus has a stiffness configuration similar to that of the rear wall 20 or the FIG. 1 collection compartment 10, for providing the same non-distorting, non-occluding operation.

With further reference to FIG. 6, the container system 60, in addition, has a further compartment 88 that connects with the passage 64. The preferred connection, as illustrated, is by way of a T-coupling 90 in the third coupling stage 86 and a tubing link 92. The T-coupling 90 preferably is located along the third coupling stage 86 between the pump-engaging portion thereof and the plasma compartment 66. With this arrangement, the further compartment 88 connects with the passage 64 downstream, relative to the collection compartment 62, from the engagement of the coupling stage 86 with a peristaltic or like pump, and closely upstream from the plasma compartment 66.

The further compartment 88 typically is fabricated similar to the construction of the plasma compartment 14 of the container system 10 described above with opposed flexible walls sealed together at peripheral edges. The walls of the further compartment, in addition to being flexible, are of oxygen permeable material as is known in blood collection and processing container structures.

Figure 5:
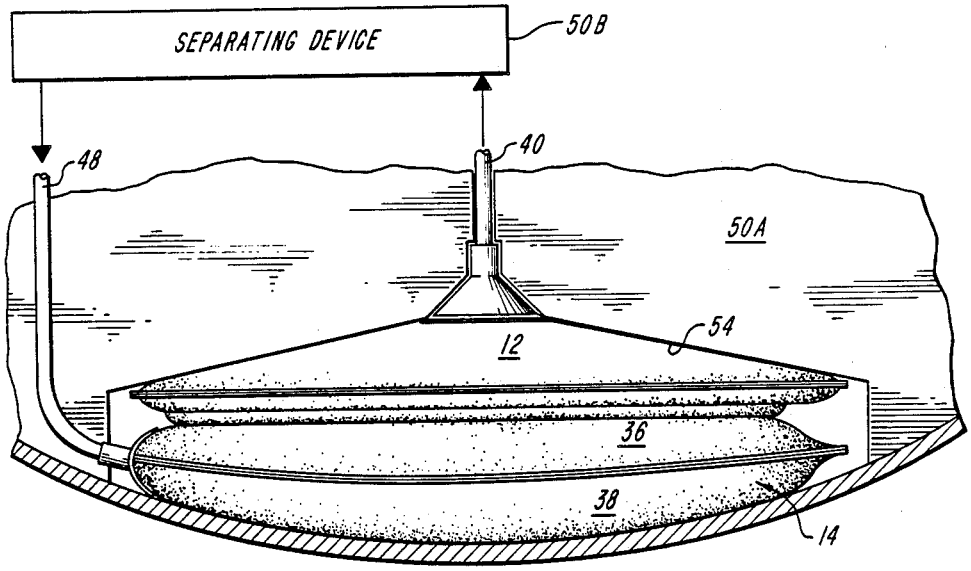
FIG. 5 is a view similar to FIG. 4 subsequent to the removal of a major portion of the liquid volume from the collection compartment to the inter-connecting passage and to the plasma compartment.

The container system 60 is arranged for disposition in separation equipment such as is described above with reference to FIGS. 4 and 5 with the tubing link 92 feeding vertically upward and the further compartment 88 disposed vertically above the passage 64. This configuration encourages any air or other gas in the container system to exit from the passage 64 and enter the tubing link 90 to the compartment 88. The compartment thus serves to receive and collect air and other gas that may be present in the container compartments 62 and 66 and the passage 64. The connection of the compartment 88 with the passage 64 downstream from the engagement with a peristaltic pump, as described, is deemed preferable to enhance the collection of air and other gas in the compartment 88.

A further function of the compartment 88 in the container system 60 is to allow a fractionated component which collects in the second storage stage 84 to be expressed into the compartment 88 and, where desired, diluted with plasma from the compartment 66 or with other liquid introduced into the compartment 88 by way of a sealable external port 94. This processing and treatement of an isolated blood component is desirable, for example, with blood platelets where it is desired to avoid maintaining them densely packed for an undue period. In one illustrative practice, after blood collected in the collection compartment 62 of the system 60 is fractionated and isolated in the manner described with reference to FIGS. 1 through 5, so that blood platelets are isolated in the second storage stage 84, the container system 60 allows the platelets to be expressed into a large volume, namely the compartment 88, while still maintaining the sealed, sterile condition of the container system. The second storage stage 84 accordingly is sufficiently. flexible to allow an operator or mechanism to manipulate the stage 84 and the coupling stage 86 to transfer the isolated platelets into the compartment 88. For this purpose the passage 64 preferably is occluded or otherwise closed at the entry to the plasma compartment 66, i.e., just downstream of the T-coupling 90, to ensure that platelets do not enter the plasma compartment 66. After the platelets are expressed into the compartment 88, plasma can be expressed from the compartment 66 into the compartment 88 where desired. The tubing link 92 can be sealed closed after the platelets and any plasma are isolated therein.

It is to be understood that in a preferred embodiment of the container system 60 of FIG. 6, each coupling stage 78, 82 and 86 can be monitored with an external sensor, where desired, and can be occluded or otherwise closed as desired to suit the mechanism with which the container system is used and the processing desired for each isolated fraction of the liquid being processed therein.

Figure 7:
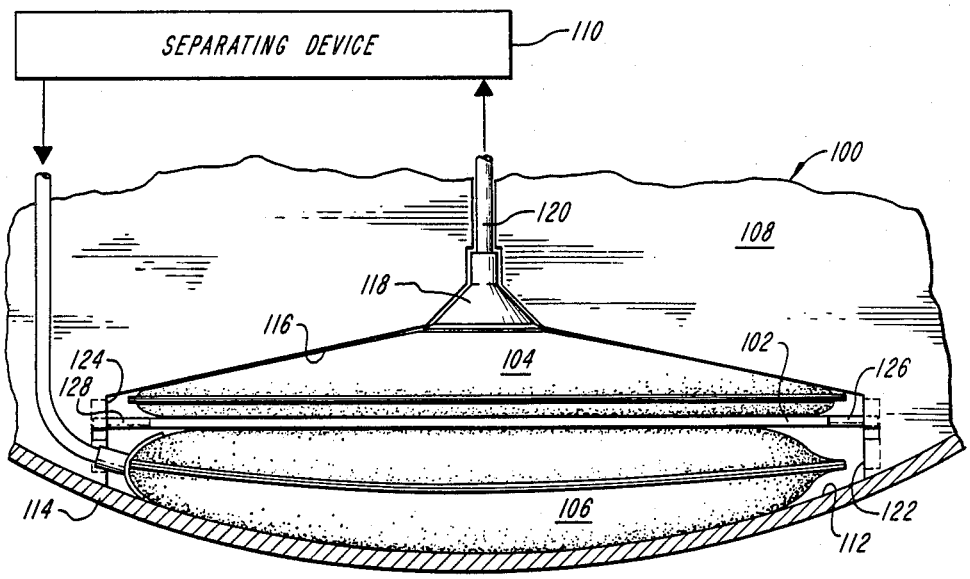
FIG. 7 is a view similar to FIGS. 4 and 5 showing a separating instrument embodying further features of the invention.
Figure 8:
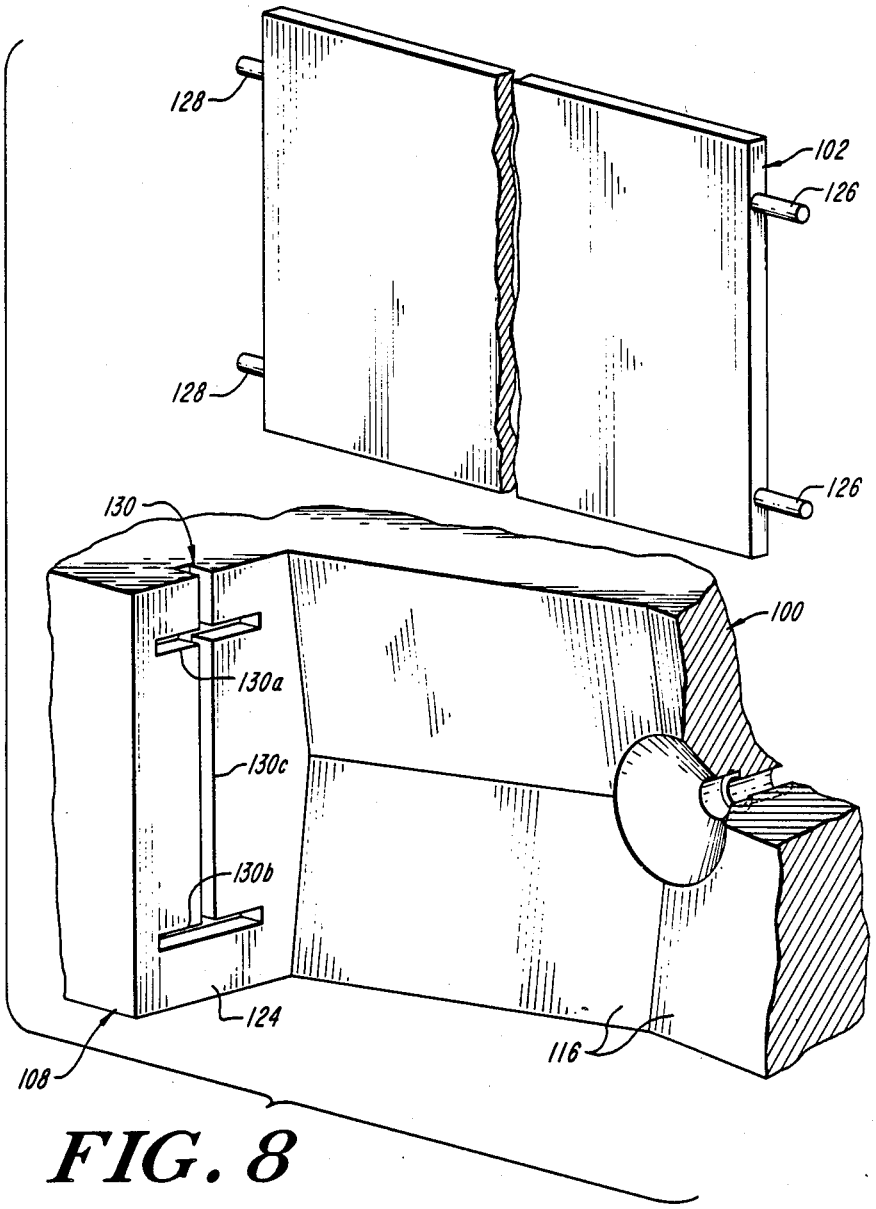
FIG. 8 is a fragmentary perspective view, partly exploded, of the instrument of FIG. 7.

With reference to FIGS. 7 and 8, the invention can also be practised with a separating instrument 100 that provides a pressure panel 102 for disposition between the radially-stacked collection compartment 104 and the plasma compartment 106 of a container system of the type described above with reference to FIGS. 1 through 6. In this instance, the container compartment walls can all be flexible, i.e., free of any pressure panel or like stiffening element for preventing distortion and occlusion as described above. The illustrated instrument 100 is similar to the instrument 50 of FIGS. 4 and 5, and has a rotor 108 coupled with separating elements 110 that typically include valves for occluding the container passage 120 at one or more selected locations, sensors for monitoring the character of liquid within the container passage, and a peristaltic or like pump for engaging the container passage.

A rotor receptacle 112, typically one of several uniformly distributed about the periphery of the rotor 108, has an outer wall 114 that forms part of the outer drum surface of the rotor 108, and has a conical inner wall 116 centrally apertured to receive and seat a conical exit port 118 and tubing-like passage section 120 of the container system. Receptacle end walls 122 and 124 span between the radially spaced inner and outer walls. The centrifuge rotor 108 typically is fabricated in parts which can be disassembled and reassembled in order to receive the container exit port and passage.

The centrifuge receptacle 112 supports the pressure panel 102 disposed between the container compartments 104 and 106, much like the FIG. 1 pressure panel 28 on the collection compartment 12 of that embodiment and much like the pressure panel 72 of the plasma compartment 66 of the container 60 shown in FIG. 6. The pressure panel which the separating instrument 100 provides thus is contiguous with and abuts the radially outer, rear wall of the collection compartment and the radially inner, front wall of the plasma compartment. In particular, the illustrated separating device 100 mounts and supports the pressure panel 102 to locate it laterally, i.e., along the length and height dimensions of the receptacle 112 and with relative freedom to move radially within the receptacle. The illustrated separating device provides this mounting with a pair of pins 126 and 128 laterally projecting from each lengthwise side of the panel 102, as appears in FIG. 8. The pins 126 and 128 are parallel and coplanar with the flat planar panel 102.

Each receptacle end wall 122, 124 is slotted to receive one pair of pins 126, 128 respectively. With specific reference to the end wall 124 shown in FIG. 8, the end-wall slot 130 includes a pair of substantially horizontally parallel slots 130A and 130B, each of which extends generally in a radial direction and which slideably receives one pin 128. A further vertical slot 130C extends to the top of the receptacle end wall 124 from the lower slot 130B, and intersects substantially the mid point of each slot 130A and 130B, as shown. This vertical slot 130C provides a passage for assembling the panel 102 with the centrifuge, and allowing the panel to be removably replaced. With this illustrated supporting mount for the instrument pressure panel 102, the panel is essentially fixidly located relative to the lateral dimensions of the container compartments when loaded in the receptacle, and is substantially free to move radially. The panel 102 transmits internal pressure between the two container compartments so that they remain at the same internal pressure and maintains the back wall of the collection compartment 104 essentially planar and undistorted.

It will thus be seen that the invention efficiently attains the objects set forth above, among those made apparent from the preceeding description. Since certain changes may be made in the above constructions without departing from the scope of the invention, it is intended that all matter contained in the above description or shown in the accompanying drawings be interpreted as illustrative and not in a limiting sense. As one illustrative instance, various structures and arrangements can be employed to provide a pressure panel in a centrifugal separating device for providing the operation and functions described herein for the illustrative embodiments.

It is also to be understand that the following claims are intended to cover all the generic and specific features of the invention herein described, and all statements of the scope of the invention which, as a matter of language, might be said to fall therebetween.

Having described the invention, what is claimed as new and secured by Letters Patent is:

1. Container apparatus for containing liquid during centrifugal fractionation and component-isolation, said apparatus having the improvement comprising A. means forming a flexible container front wall having a first peripheral edge contour, B. means forming a liquid-funneling port on said front wall substantially centrally within said periphery, and C. means forming a container back wall having a second peripheral edge contour, said back wall being substantially opposite and coexstensive with said front wall, (1) said back wall means having a flexible peripheral portion bordering a substantially noncompliant inner portion, (2) said inner portion being opposite said funneling port and having an area larger than the area of said port at said front wall for extending on said back wall laterally beyond the lateral extent of said port at said front wall.

2. Container apparatus according to claim 1 having the further improvement

A. wherein said front wall means and said back wall means have substantially identical peripheral edge contours, and B. comprising means sealing said front wall means to said back wall means along the peripheries thereof.

3. Container apparatus according to claim 2 having the further improvement comprising A. a further container having front and back walls each with substantially the same flexibility as said first-mentioned container and having peripheral edge contours substantially identical to said first peripheral contours, and B. means forming a liquid passage communicating between said exit port and the interior of said further container.

4. Container apparatus according to claim 1 having the further improvement comprising an inner surface on said front wall means and on said port means resistant to entrapment of fractions of the liquid being fractionated.

5. Container apparatus according to claim 1 having the further improvement comprising an inner surface on said front wall means and on said port means oriented and finished for minimal collection thereon of fractions of the liquid being fractionated.

6. Container apparatus according to claim 1 having the further improvement comprising smooth and nonadhesive inner surfaces on said front wall and on said port means for minimal pick-up of fractions of the liquid being fractionated.

7. Container apparatus according to claim 1 having the further improvement wherein A. said funneling port has an interior liquid passage having a circular cross section and which apertures a minor area of said front wall, and B. said back wall inner portion is centrally located relative to the back wall periphery and constitutes a major area of said back wall.

8. Container apparatus according to claim 1 having the further improvement

A. wherein said back wall inner portion is substantially planar when said container is empty and when said container contains a selected volume of liquid to be fractionated, and B. said front wall and said back wall peripheral portion are normally planar when said container is empty and compliantly deform concavely comparably in opposite directions when said container contains a selected volume of liquid.

9. Apparatus for containing liquid during centrifugal fractionation and component-isolation, said apparatus comprising A. a first pillow-like flexible compartment having opposed conjoined front and back walls, said back wall having a substantially nonflexing central portion, B. a fluid exit port aperturing said front wall centrally thereon, C. said compartment having a thickness dimension between said front and back walls with a maximum value at the location of said exit port and with a progressively decreasing value with increasing spacing therefrom to the compartment periphery, D. said compartment having first and second lateral dimensions transverse to one another in a plane transverse to said thickness dimension, with E. said maximum thickness dimension being less than each of said first and second transverse dimensions, and said transverse dimensions having a squaroid aspect ratio, and F said front wall normally assuming, when said compartment contains a selected volume of liquid, a funneling contour with the apex thereof being at said exit port.

10. In apparatus for the centrifugal fractionating and component isolation of liquid, the improvement comprising pressure-panel means for disposition between and contiguous with a radially outer wall of a collapsible first container of liquid and a radially inner wall of a collapsible second container of liquid, said panel means being substantially nonflexing and being radially movable with said container walls responsive to volume changes in said first and second containers for maintaining the shape of an interface between said walls of said first and second containers.

11. In apparatus according to claim 10, the further improvement wherein the said pressure panel means is arranged for maintaining the container walls contiguous therewith substantially free of radial distortion during centrifugal fractionating.

12. Apparatus for the centrifugal fractionation and component isolation of liquid, said apparatus comprising A. first container means for liquid and having opposed front and back walls, B. second container means for liquid, said first and second container means being arranged for radially stacked disposition with said second container means radially outward of said first container means, C. passage means connected between said first and second container means and providing fluid communication between said first and second container means, and D. substantially nonflexing panel means arranged for disposition between said radially stacked container means and in pressure communication with the radially opposed walls thereof and radially movable for transferring internal pressure between said first and second container means.

13. Apparatus according to claim 12 further comprising exit port means located centrally on said front wall of said first container means and connected with said passage means for providing said fluid communication with the interior of first container means, said exit port means being radially inward of said back wall of said first container means and of said panel means when said container means are in said radially stacked configuration.

14. Apparatus according to claim 12 further comprising means on said panel means for constraining said back wall of said first container means in a substantially nondistorted occlusion-free disposition.

15. Apparatus according to claim 12 further comprising flexible wall means on each of said first and second container means, said two wall means radially opposing one another within said radially stacked configuration.

16. Apparatus according to claim 12 in which one of said first and second container means carries said panel means on one of said first container back wall and a front wall of said second container, and in which the other of said container means has a flexible wall portion radially opposite and facing said panel means when in said radially stacked configuration.

* * * * *